United States Patent [19]

Hagglund et al.

[11] 4,296,311

[45] Oct. 20, 1981

[54] ELECTRIC HOT PLATE

[75] Inventors: Erik H. M. Hagglund, New Canaan; Roger R. Giler, Wilton, both of Conn.

[73] Assignee: The Kanthal Corporation, Bethel, Conn.

[21] Appl. No.: 66,684

[22] Filed: Aug. 15, 1979

[51] Int. Cl.[3] ..... H05B 3/74

[52] U.S. Cl. ..... 219/464; 219/463; 219/467; 219/520; 219/536; 219/542; 338/315

[58] Field of Search ..... 219/402, 403, 436, 458, 219/463–465, 467, 520, 532, 536, 537, 542, 546, 447, 445, 476, 480, 357; 338/304, 306, 315–319

[56] References Cited

U.S. PATENT DOCUMENTS

| | | | |
|---|---|---|---|
| 1,378,247 | 5/1921 | Lightfoot | 219/357 |
| 1,870,666 | 8/1932 | Baynard | 219/520 |
| 2,465,685 | 3/1949 | Henderson | 338/318 |
| 2,987,603 | 6/1961 | Thomson | 338/317 |
| 3,355,575 | 11/1967 | Bassett, Jr. et al. | 219/464 |
| 3,486,003 | 12/1969 | Cox | 219/463 |
| 3,899,655 | 8/1975 | Skinner | 219/403 |
| 3,912,905 | 10/1975 | Giler | 219/464 |
| 4,034,206 | 7/1977 | Penrod | 219/464 |

FOREIGN PATENT DOCUMENTS

| | | | |
|---|---|---|---|
| 259587 | 1/1949 | Switzerland | 219/459 |
| 542278 | 1/1942 | United Kingdom | 219/357 |

*Primary Examiner*—Gene Z. Rubinson
*Assistant Examiner*—Bernard Roskoski
*Attorney, Agent, or Firm*—Kenyon & Kenyon

[57] ABSTRACT

An electric hot plate has a molybdenum disilicide resistance wire heating element spaced above a fibrous refractory pad by wire supports and spaced below a transparent glass plate forming a cooking surface. The pad has a smooth top surface, the wire is looped back and forth sinuously or possibly spirally coiled to form a layer which is parallel with the pad surface and the glass plate, and the wire is designed to operate at temperatures preferably of from about 2300° to 2500° F. or higher, at which temperatures the pad surface has been found to be effective for diffusely reflecting upwardly the wire heat radiation.

1 Claim, 3 Drawing Figures

ELECTRIC HOT PLATE

BACKGROUND OF THE INVENTION

There have been various proposals for making an electric hot plate having a transparent glass top up through which cooking heat is radiated, and which can be incorporated into an electric cooking stove.

In 1971 U.S. Pat. No. 3,612,828 disclosed the idea of a refractory fibrous pad, such as one made of rock wool, glass wool, slag wool, asbestos or the like, having a top surface in which a deep sprial groove is formed and in which a sinuous strand of flat resistance wire is nested to form a heating element with the glass plate spaced above. To prevent excessive heat conduction from this wire to the pad which via the grooves encloses the bottom and sides of the wire, the fibrous material contains a uniform dispersion of finely divided opacifier substance so that the pad's bottom and side walls forming the groove diffusely reflect heat back to the wire which directly contacts these walls.

In 1974 U.S. Pat. No. 3,833,793 proposed that the surface of the pad be formed as a flat planar surface and that the resistance wire be in the form of coiled round wire pinned to the pad by staples, the glass plate being spaced above this round wire element. This is for the purpose of reducing heat conduction from the wire to the pad.

Both of the above patent proposals used metal alloy resistance wire which must be operated at temperatures below 2000° F. and both relied on the wire element being extensive enough to provide a large heat radiating surface area. Therefore, both have the disadvantage of being slow to heat from ambient temperature up to cooking temperature as compared to a gas stove, and both have the disadvantage that excessive heat is lost by conduction to the pad.

In 1975 U.S. Pat. No. 3,912,905 proposed a glass-top hot plate using a layer of molybdenum disilicide resistance wire resting directly on a pad of compacted fibrous refractory material, with a glass plate spaced above. The pad surface is roughened to provide upstanding fibers on which the wire rests. The wire is designed to be heated to temperatures substantially above 2000° F. at which temperature the upstanding fibers fuse, the intent being to in this way position the wire against shifting on the pad if roughly treated as during shipping. Testing showed that the fibers, being ceramic in nature, became fragmented and did not perform their intended function. However, because molybdenum disilicide wire is preferred, the element can be designed so that upon being powered it substantially immediately flashes from ambient to full operating temperatures embracing the temperature of 2350° F. which U.S. Pat. No. 3,612,828 discloses as being the infrared optimum heater element temperature. To this extent, this hot plate might be competitive with the instantaneous heating obtained by a gas stove. However, it has been found that a substantial amount of heat is lost by conduction to the pad on which the molybdenum disilicide wire directly rests after fusion of the fibers provided to anchor the wire against shifting.

In 1976 U.S. Pat. No. 3,987,275 proposed a glass-top unit using metal sheathed electric resistance wire with the sheath flattened and pressed directly against the bottom of the glass by a metal spider, with the pad spaced below and its top surface covered by aluminum foil to act as a reflector. The effect is primarily a heated glass cooking surface relying on conduction rather than heat radiation through the glass to the cooking vessel.

Consequently, it can be seen that the prior art has been presented with the unsolved problem of providing a glass-top hot plate that is competitive with a gas stove as to rate of heat production from ambient temperature, which does not involve a substantial loss of heat to the refractory fibrous pad supporting the resistance element, and which heats a cooking vessel truly by radiation as contrasted to conduction.

SUMMARY OF THE INVENTION

According to the present invention, a molybdenum disilicide wire heating element is used, designed so that when powered by its rated voltage it substantially immediately flashes to temperatures above 2000° F., preferably to within the range of 2350 to 2450° F., this mateial being capable of going to 2500° F. and above as the wire is commercially available. The wire can be formed with either of the shapes shown by U.S. Pat. No. 3,912,905 to form a single or possibly multiple layer. The usual refractory fibrous pad material is used, but the pad can be formed with a plain flat top surface. A transparent glass cooking plate is spaced above the pad to define a space above the pad and the wire element is supported about midway in this space by thin wire supports using wire material that is not reactive with the molybdenum disilicide wire at the temperatures indicated. The wire supports can be made in the form of staples having leg ends pushed in the fibrous pad and top ends bent to form saddles in which the molybdenum disilicide wire rests, some of the wire supports preferably being formed as loops holding the molybdenum disilicide wire element in case the hot plate is inverted as might occur during shipment.

With this arrangement there is substantially no direct heat conduction from the hot resistance wire to the pad because the wire supports are too small in cross section to be effective heat conductors. At the operating temperatures indicated, the usual fibrous pad material surprisingly forms an effective diffuse reflector reflecting the heat radiated downwardly through space from the hot resistance wire, upwardly through the glass plate above and to a cooking vessel on the plate. Most commercially available fibrous refractory pad materials are translucent, and when this hot plate "lights-up", light can be seen from the bottom of the pad, but heat radiation having wave lengths characteristic of the element's high operating temperatures is diffusely reflected upwardly.

DESCRIPTION OF THE DRAWINGS

An example of the present invention is illustrated by the accompanying drawings, in which.

DETAILED DESCRIPTION OF THE INVENTION

Figure 1:
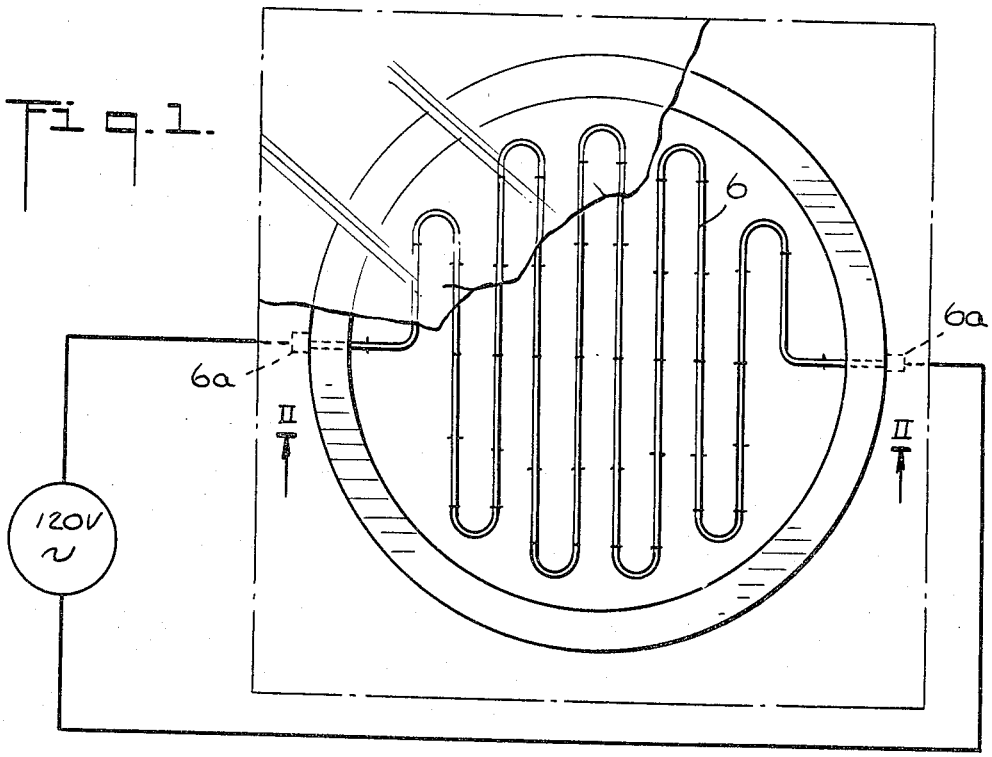
FIG. 1 is a top view.
Figure 2:
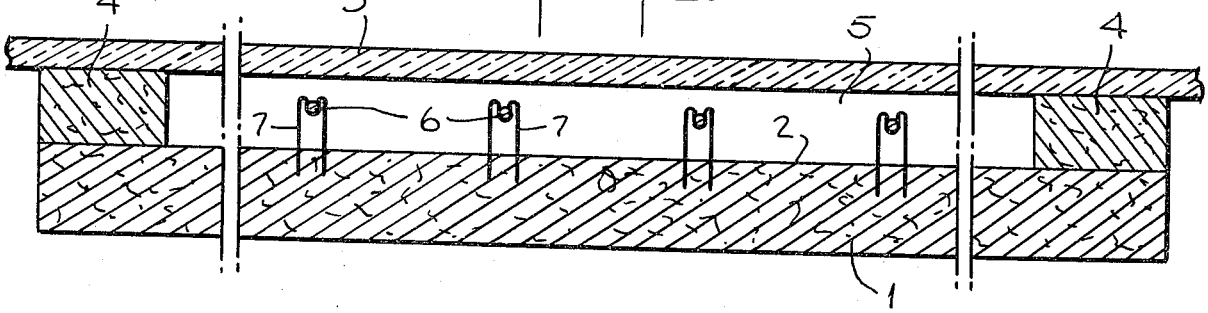
FIG. 2 is a cross section taken on the line II—II in FIG. 1.
Figure 3:
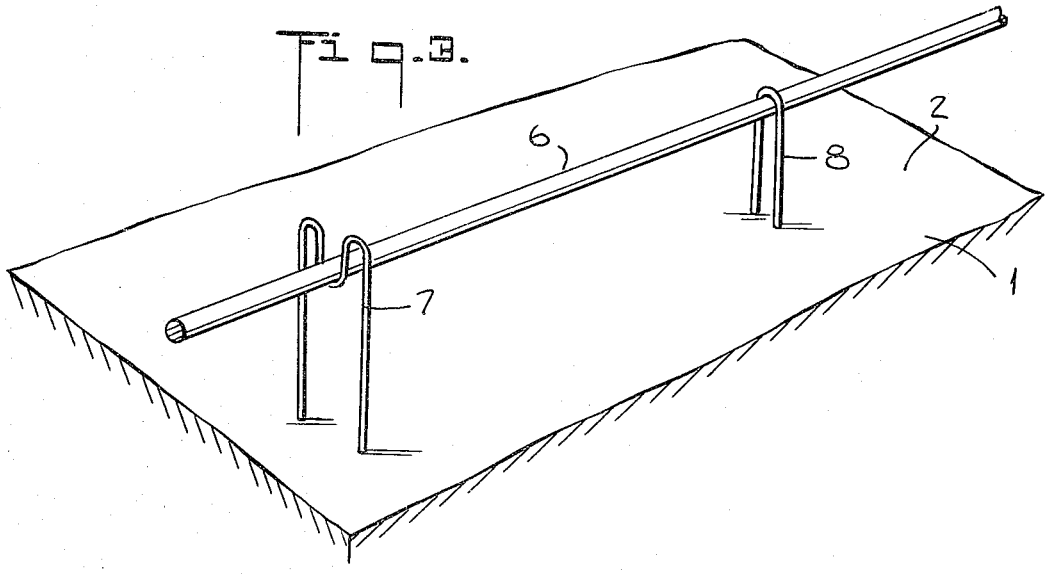
FIG. 3 is a perspective view on an enlarged scale showing the molybdenum disilicide wire strand with its wire supports spacing the wire above the pad.

As shown by the drawings, the refractory fibrous pad 1 has a plain flat top surface 2. This pad can be made of various refractory fibrous materials of the kind referred to before, the material actually used when practicing this invention being vacuum-formed ceramic fibers, sold by Johns-Manville under the tradename "FIBER-CHROME" and consisting basically by weight of 55% $SiO_2$, 40.5% $Al_2O_3$ and 4% of $Cr_2O_3$, these being in fiber form and the fibers being bonded together by means of an inorganic binder forming the balance. This material is rated for maximum operating temperatures of 2700° F. Other commercially available refractory fibrous material can be used.

Conventionally fibrous refractory pad material is light in color, being substantially white or off-white, and it is translucent to light when used in thickness providing a pad of adequate strength for hot plate constructions. In practicing the present invention, typical pad thickness have ranged from ¾ to 1" thick, practical considerations indicating a possible pad thickness range of from ⅜ to 1½". The glass plate 3, which provides the cooking surface, is spaced above the top 2 of the pad 1 by any suitable spacing means 4 so that a space 5 is formed between the glass and the pad surface. The glass top is, of course, transparent and suitable glass is available on the open market, representative glass being "PYROCERAM" from Corning, "HERCUVIT" from Pittsburgh Plate Glass, "CERVIT" from Owens-Illinois and "CERAN" from Schott. "HERCUVIT" 4 mm thick, is recommended but a 5.5 mm thickness provides greater strength with slight loss of thermal transmission efficiency.

The molybdenum disilicide wire element 6 is supported approximately midway up in the space 5, and preferably so that the element is spaced about ⅛" above the pad surface 2. The wire is shown as formed as a layer of single wire thickness positioned parallel to the surface 2 and glass plate 3 by means of the thin wire supports 7 and 8, the supports 7 being formed as saddles in which the wire 6 rests and the supports 8 being formed as loops over the wire to guard against wire displacement by possible inversion of the hot plate. The supports have legs stuck into the fibrous pad, extending straight up from the pad.

It can be seen that the molybdenum disilicide wire element 6 forms a layer that, insofar as mechanically possible, floats in the space 5 part way between the pad surface 2 and the bottom of the glass plate 3. It, of course, has terminal ends 6*a* for connection with electric power.

Using the sinuated shape illustrated by FIG. 1, an example of a suitable element designed for 115 volts AC could have sixteen legs interconnected in series by looped ends with the wire having an overall length of 121" of 0.65 mm diameter molybdenum disilicide wire and, of course, provided with suitable terminal connections. This would have an operating temperature of approximately 2372° F. at its rated voltage.

The supports 7 and 8 can be made of molybdenum disilicide wire but this material cannot be shaped by bending when cold. It has been generally known that metal alloy wire in contact with molybdenum disilicide wire at the operating temperatures of this element results in a reaction between the two parts with destructive consequences.

However, it has been found that metal alloy wire of the Fe-Cr-Al type can be given an oxide coating which effectively protects the two parts against any interaction. This metal alloy wire can be heated in air to at least 1800° F. so as to with time develop the oxide coating.

The molybdenum disilicide wire diameters for hot-plate use can range from 0.018" to 0.04" in diameter, a diameter of 0.024 being considered as typical, the length being calculated to provide the operating temperature desired for the voltage for which the element is designed. The support wire of Fe-Cr-Al alloy should have a diameter no greater than the resistance wire and be made as small as possible consistent with the stiffness required to support the molybdenum disilicide element, a typical wire support diameter being 0.0159" or, in other words, 26 gauge. This can easily be bent to form the saddles and loop supports, the shapes of which are not critical providing they are capable of their intended function. The refractory fibrous pad can range from ⅜" in thickness upwardly, but its thickness would typically be from ¾" to 1". The pad is sufficient to provide firm anchorages for the legs of the various supports.

Molybdenum disilicide wire is sold under the trademark "KANTHAL SUPER" and Fe-Cr-Al electric resistance wire is sold under the trademark "KANTHAL", both products being available from the Kanthal Corporation in the U.S.

When a hot plate constructed as described is initially powered or "turned-on", the molybdenum disilicide wire practically immediately flashes to its full operating temperature so that cooking on the glass plate can be started immediately. The thermal energy is radiated upwardly through the glass plate with high efficiency both directly from the hot wire itself and by diffuse reflection from the pad's surface spaced beneath the hot wire. Because the reflection is diffused by the nature of the pad's surface, a cooking vessel on the glass top is heated more uniformly than if heated solely by direct radiation from the hot wire. The wire supports where in direct contact with the hot incandescent molybdenum disilicide wire, represents very small masses which themselves almost immediately reach the operating temperature of the molybdenum disilicide wire so there is no appreciable heating lag at those locations, but downwardly, because of the small diameter and extents of the wire support legs, the wire temperature rapidly drops so that only a small amount of heat can be conducted to the refractory fibrous pad below. The pad itself reflects upwardly heat radiated at the temperatures described, upwardly past the hot wire element and through the glass plate cooking surface.

This invention permits the use of the refractory fibrous pad material that is easily commerically available, without requiring the use of opacifiers as a special order, although they can be incorporated if desired. As previously noted, when the pad does not incorporate opacifiers, the incandescent element can be seen through the bottom of the pad, and it is not believed that the efficiency of the hot plate can be improved by using an opaque pad material.

The prior art suggests that opacifiers must be used with heating elements operating at temperatures no higher than 2000° F. With the higher operating temperatures substantially above 2000° F., as represented possibly by the so-called optimum temperature of 2350° F., the wave lengths of the radiations are such that the usual refractory fibrous pad material, unaided by opacifiers, and translucent in character, becomes an efficient reflector of the resulting thermal radiation.

What is claimed is:

1. An electric cooking stove assembly comprising a glass plate, a convoluted molybdenum disilicide electric resistance heating wire forming a layer of interspaced convolutions substantially parallel with and spaced below said plate and having ends for connection with electric power, a refractory fibrous pad positioned below and completely free from contact with said layer and having a flat top surface substantially parallel with said layer, and means for supporting said layer so that when hot it radiates heat upwardly both directly and by reflection from said fibrous pad, the molybdenum disilicide wire of said element having a diameter and length which causes the wire to heat to temperatures substantially above 2000° F. when electrically powered at its rated voltage and at least the pad's said top surface having a substantially white color causing appreciable diffused reflection of thermal energy having wave lengths inherent to said temperatures, said means comprising interspaced support wires having lower ends stuck in said fibrous pad, said support wires extending straight upwardly from the pad's said top surface, said wires having upper portions spaced above said pad and forming loops in which said molybdenum disilicide wire is positioned and thereby supported, said support wires having diameters no greater than said diameter of said molybdenum disilicide and made of metal alloy of the Fe-Cr-Al type and having an oxide coating protecting against reaction with said element.

* * * * *